US007770348B2

(12) United States Patent
Tollenaar

(10) Patent No.: US 7,770,348 B2
(45) Date of Patent: Aug. 10, 2010

(54) METAL STUD INSTALLATION APPARATUS AND METHOD

(75) Inventor: Daniel W. Tollenaar, Des Moines, IA (US)

(73) Assignee: Kathy M. Tollenaar, Des Moines, IA (US)

( * ) Notice: Subject to any disclaimer, the term of this patent is extended or adjusted under 35 U.S.C. 154(b) by 812 days.

(21) Appl. No.: 11/623,212

(22) Filed: Jan. 15, 2007

(65) Prior Publication Data

US 2008/0168733 A1 Jul. 17, 2008

(51) Int. Cl.
*E04C 2/34* (2006.01)

(52) U.S. Cl. ..... 52/481.1; 52/241; 52/281; 52/656.9; 52/696

(58) Field of Classification Search ..... 52/481.1, 52/481.2, 483.1, 506.01, 241, 242, 243, 281, 52/656.1, 696, 656.9, 690
See application file for complete search history.

(56) References Cited

U.S. PATENT DOCUMENTS

| | | | | | |
|---|---|---|---|---|---|
| 2,936,049 | A * | 5/1960 | Hovind | 403/217 |
| 3,001,615 | A * | 9/1961 | Ries | 403/230 |
| 3,332,188 | A * | 7/1967 | Schaefer | 52/349 |
| 5,040,345 | A * | 8/1991 | Gilmour | 52/243.1 |
| 5,237,786 | A * | 8/1993 | Kochansky | 52/126.4 |
| 5,325,651 | A | 7/1994 | Meyer | |
| 5,471,805 | A | 12/1995 | Becker | |
| 5,660,012 | A | 8/1997 | Knudson | |
| 5,755,066 | A | 5/1998 | Becker | |
| 7,284,355 | B2 * | 10/2007 | Becker et al. | 52/712 |
| 7,640,701 | B2 * | 1/2010 | Rutherford | 52/243 |
| 2002/0002803 | A1 * | 1/2002 | Atkin | 52/241 |

FOREIGN PATENT DOCUMENTS

KR 20-0399554 10/2005

OTHER PUBLICATIONS

Color Copy—4 sheets pp. 26-29 from a website brochure—entitled Deflection Connections—The SLP-TRK Slotted Track, by Dietrich Metal Framing. The website address is dietrichmetalframing.com.
Color Copy—1 sheet from a website—entitled Fire Trak Corp. showing a Posi Klip Details section, by Fire Trak Corp. The website address is firetrak.com.

* cited by examiner

*Primary Examiner*—Brian E Glessner
*Assistant Examiner*—Adriana Figueroa
(74) *Attorney, Agent, or Firm*—Sturm & Fix LLP

(57) ABSTRACT

A method and apparatus for installing steel studs to make a wall includes a first and second track each having a center portion, an inner lip extending from the center portion and an outer lip extending from the center portion. A first flange goes on each side of the inner lip of the first track. A second flange goes on each side of the inner lip of the second track. A U-shaped stud is provided having at least a portion of an inner lip of the stud being disposed between the first tab and the inner lip of the first track and at least a portion of the inner lip of the stud being disposed between the second tab and the inner lip of the second track.

18 Claims, 9 Drawing Sheets

Fig. 3
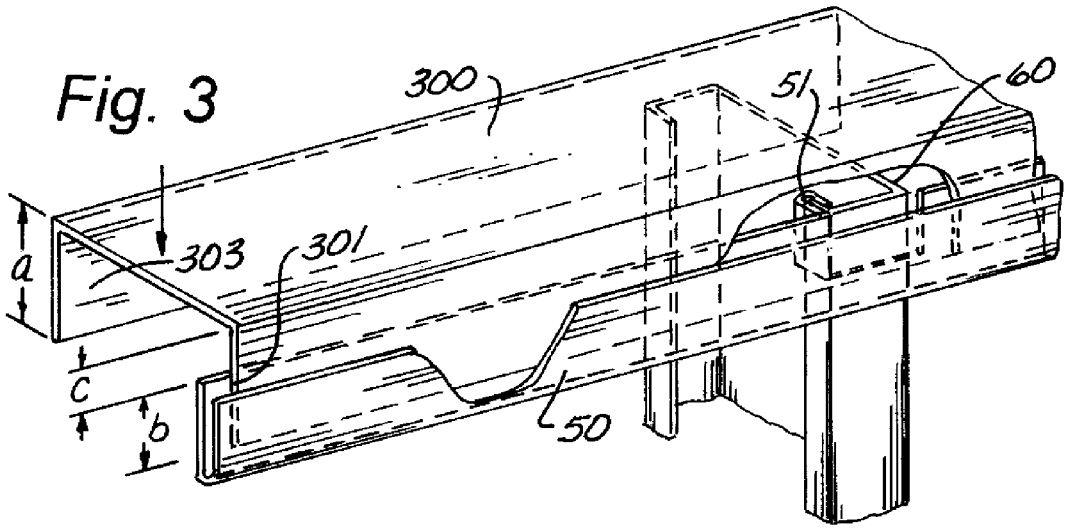
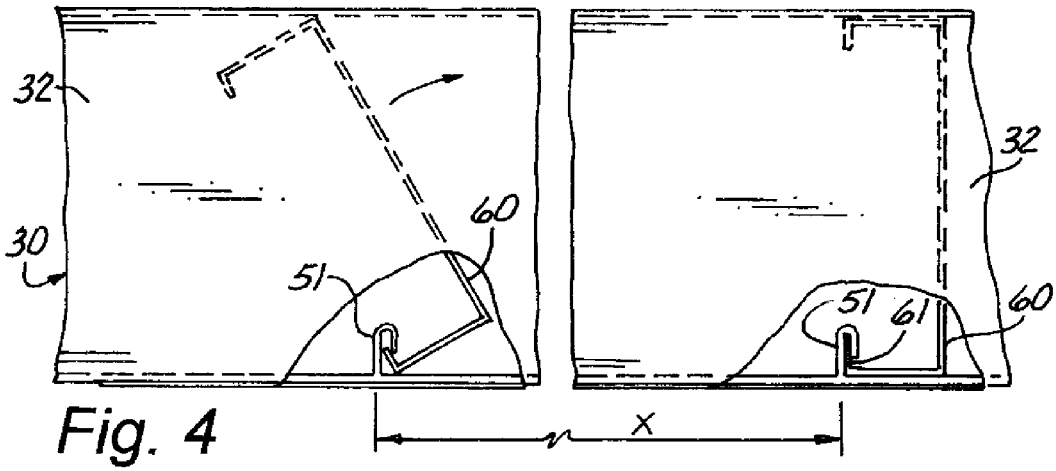
Fig. 4
Fig. 5
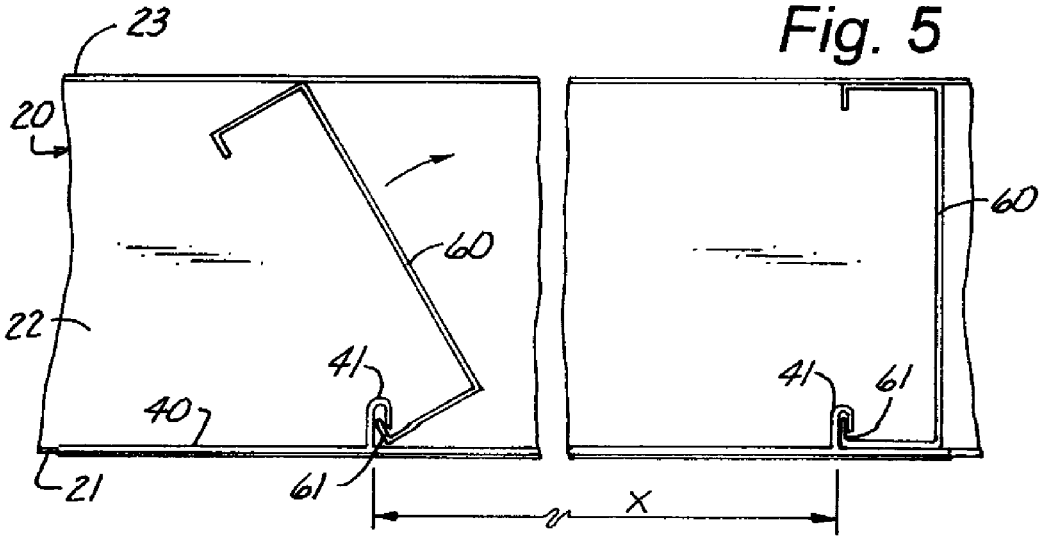

Fig. 11
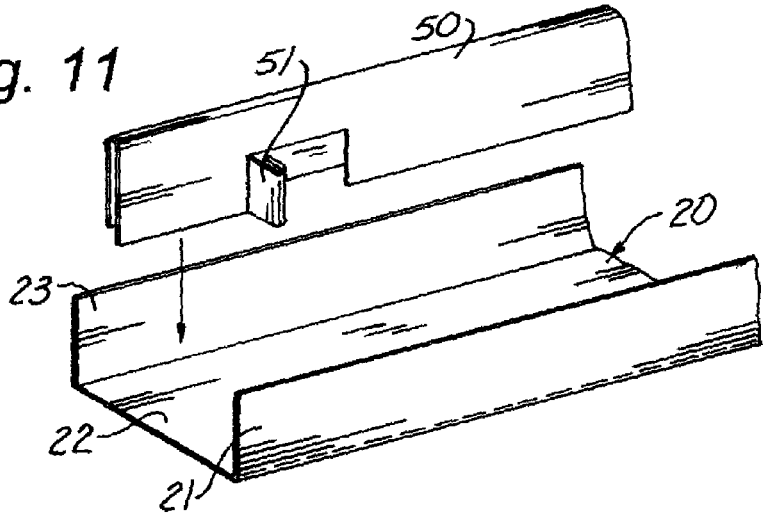
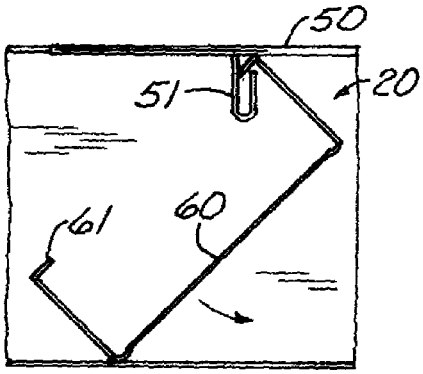
Fig. 12
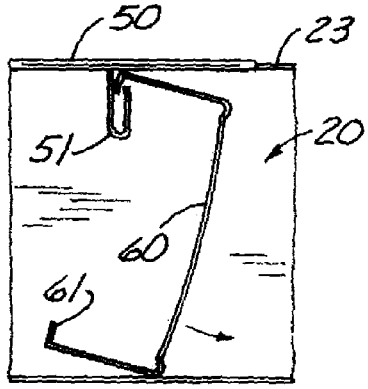
Fig. 13
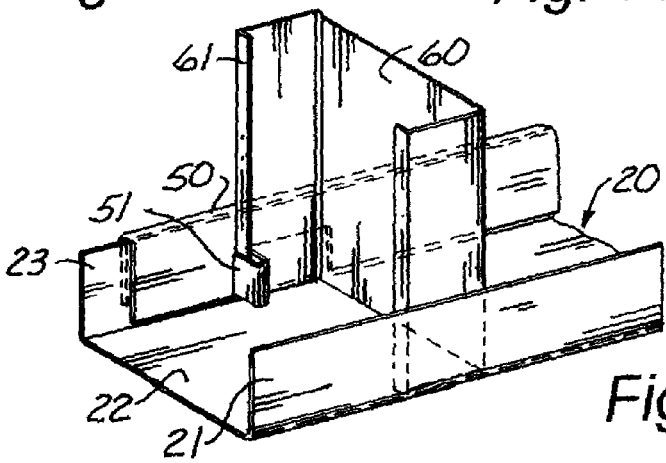
Fig. 14

METAL STUD INSTALLATION APPARATUS AND METHOD

BACKGROUND OF THE INVENTION

1. Field of the Invention

The present invention relates to wall construction, and more particularly to a method and apparatus for installing metal studs in a building.

2. Description of Prior Art

Historically, the framework of a building wall was formed entirely of wood members, including wooden studs. In recent years at least in the United States, however, the use of metal studs has gained acceptance, especially in commercial buildings, such as office buildings and hospitals. It has been found that metal studs can be advantageously employed, since a suitable metal, such as galvanized steel, is stronger than wood, will not rot, is not subject to damage by pests such as termites, remains resistant to fire, and is economically feasible.

Metal studs are typically formed of sheet metal bent to encompass a cross sectional area having nominal dimensions of two inches by four inches. To conform to architectural plans and building code requirements, metal studs are formed of sheet metal bent into a generally U-shaped cross-section in which a relatively broad central base is flanked by a pair of narrower sides that are bent at right angles to the base. The base typically has a uniform nominal width of either four inches or slightly less than four inches, which is commonly referred to as the web. The sides of the U-shaped stud typically extend to a nominal distance of two inches from the base, which sides are commonly referred to as flanges. To enhance structural rigidity to the flanges of the stud, the flanges are normally bent over into a plane parallel to and spaced from the plane of the web into an L-shape. These turned over edges of the sides thereby form marginal lips which are typically one quarter to one half inch in width. Conventionally, the metal studs are erected with the webs oriented on the same side in the same direction.

The studs need to be attached at the top and bottom thereof to an upper track and a lower track, respectively. The upper track is usually at approximately ceiling height and the lower track is at the floor level. The upper track has having a first center portion, a first inner lip extending from the first center portion and a first outer lip extending from the first center portion, the first center portion being disposed substantially horizontally along a first plane. The lower track has a second center portion, a second inner lip extending from the second center portion towards the first inner lip and a second outer lip extending from the second center portion towards the first outer lip, the second center portion being disposed substantially horizontally along a second plane, the second plane being substantially parallel to the first plane of the upper track.

The conventional way to install the studs is to first install the upper and lower tracks, measure, and layout the studs at a predetermined distance apart, such as sixteen inches (16") center to center, and mark with a felt pen on each track where the center for each stud is to be positioned. Then the studs are clamped to the tracks at the places marked, after which the studs are attached to the upper and lower tracks with sheet metal piercing screws. Once that is done, the clamps can be removed and the process is repeated until all of the studs are attached to the tracks for the wall being built. Then, later, after all of the studs are installed, sheet rock is attached to the studs with sheet metal screws completely covering each stud in each wall. The sheet rock attachment operates to tie all of the studs and tracks together into a very solid wall. Because this system is time consuming, complex and exacting, there is a need for a better, quicker and more error proof way to accomplish the task.

Because of the perceived complexity of using metal studs in the construction of single family homes, usually these single family homes are constructed using wooden studs. Additionally, it is not uncommon that homes are built with unfinished basements, so that the homeowner can purchase the home with more square footage of living space at a lower price than if the basement was finished, with the option of finishing it later. When it comes time to finish the basement, the homeowner typically uses wooden studs, despite the fact that basements often are wet due to leakage of water through cracks in the walls or seepage through cracks in the floor. Since wood will deteriorate when exposed to moisture over a period of time, damage to such damp basement studs becomes a prevalent problem. It also creates an environment that termites prefer. Because wooden stud construction is more readily understood by the homeowner and to some extent by remodeling companies, basements are usually not finished with galvanized steel studs despite the fact that galvanized steel studs are less susceptible to damage from moisture and termites than are wooden studs. Accordingly there is a need for a steel stud installation system that is simple enough for homeowners to use for finishing basements or the like so that steel studs can easily be used instead of wooden studs.

In building construction, there are certain situations which require that there be a slip joint at the top of the upper track so that if the upper track bends in the middle due to heavy loads on top of it, such as heavy snow on a roof or heavy loads on a floor above a ceiling, that the joint between the upper track and each respective stud allows the upper track to move downwardly, and later upwardly, for example after such heavy load is gone. One way to provide such a "slip track" is to use a SLP-TRK® brand upper track available from Dietrich Metal Framing Company, in which screws extend through slots in the upper track and such screws are permanently affixed to a vertical stud so the screws can slide in such vertical slots in the upper track. This solution is quite effective, but it requires that slots be stamped through the upper track and that screws be manually inserted through such vertical slots into the top of each respective stud. There exists an added expense for the manufacturing process of stamping slots in the upper track and an added labor expense to manually place screws through such slots and into the top of studs.

Accordingly, in summary, there is a need for structures which will simplify the above identified manufactured products and for reducing the labor and expense involved in the layout and installation of walls using metal studs in both commercial and residential building construction.

BRIEF SUMMARY OF THE INVENTION

The present invention relates to a method and apparatus for the layout and installation of metal tracks and metal studs in a building wall.

The apparatus has a first track having a first center portion, a first inner lip extending from the first center portion and a first outer lip extending from the first center portion, the first center portion being disposed substantially horizontally along a first plane. A second track has a second center portion, a second inner lip extending from the second center portion towards the first inner lip and a second outer lip extending from the second center portion towards the first outer lip, the second center portion being disposed substantially horizontally along a second plane, the second plane being substantially parallel to the first plane. A first flange is operatively removably attached to the first inner lip, the first flange having first end and a second end. A first tab is operatively attached to the first flange at one end thereof and having a free end on the other end thereof, the first tab being disposed between the first inner lip and the first outer lip of the first track. A second flange is operatively removably attached to the second inner lip, the second flange having first end and a second end. A second tab is operatively attached to the second flange at one end thereof and having a free end on the other end thereof, the second tab being disposed between the first inner lip and the first outer lip of the second track. A stud is provided, the stud having a third center portion, a third inner lip extending from the third center portion and a third outer lip extending from the third center portion, the third center portion being disposed substantially vertically along a third plane, the third plane being substantially transversely disposed with respect to the first plane. At least a portion of the third inner lip of the stud is disposed between the first tab and the first inner lip of the first track and at least a portion of the third inner lip of the stud is disposed between the second tab and the second inner lip of the second track.

Therefore, an object of the present invention is the provision of an improved apparatus for use in walls using metal studs thereby permitting a simplified and less expensive method of laying out, positioning and installing same.

Another object is to provide a "slip track" option useful in conjunction with the layout and installation of metal tracks and metal studs in a building wall.

Other objects, advantages, and novel features of the present invention will become apparent from the following detailed description of the invention when considered in conjunction with the accompanying drawings.

BRIEF DESCRIPTION OF THE SEVERAL VIEWS OF THE DRAWINGS

FIG. 3 is an optional upper track which has longer downwardly extending lips so that if the upper track bends downwardly due to heavy loads thereon, the connection between the upper track and the upper end of a respective stud can slip to prevent bending of the stud as would happen if the top of such respective stud was rigidly attached to the upper track;

FIG. 4 is an enlarged top view of the upper track shown in FIG. 2, with portions of the upper track broken away, showing how the respective studs are rotated on the left side to attach to the upper track and how on the right side, the stud is already installed and attached to the upper track;

FIG. 5 is an enlarged top view of the upper track shown in FIG. 2, but with the top track removed, showing how the respective studs are rotated on the left side to attach to the lower track and how on the right side, the stud is already installed and attached to the lower track;

FIG. 11 shows a flange of the present invention being places on the rear lip of a lower track;

FIG. 12 shows how a stud can be attached to the lower track by pivoting the stud from the position on the left in the direction of the arrow to an intermediate position shown by the position of the stud on the right in FIG. 13 and ultimately to a position shown in FIG. 14, where it will remain attached to the lower track;

FIG. 14 is a perspective view of a lower portion of the stud installed using the method shown in FIGS. 12 and 13;

DETAILED DESCRIPTION OF THE BEST MODES OF THE INVENTION

Figure 1:
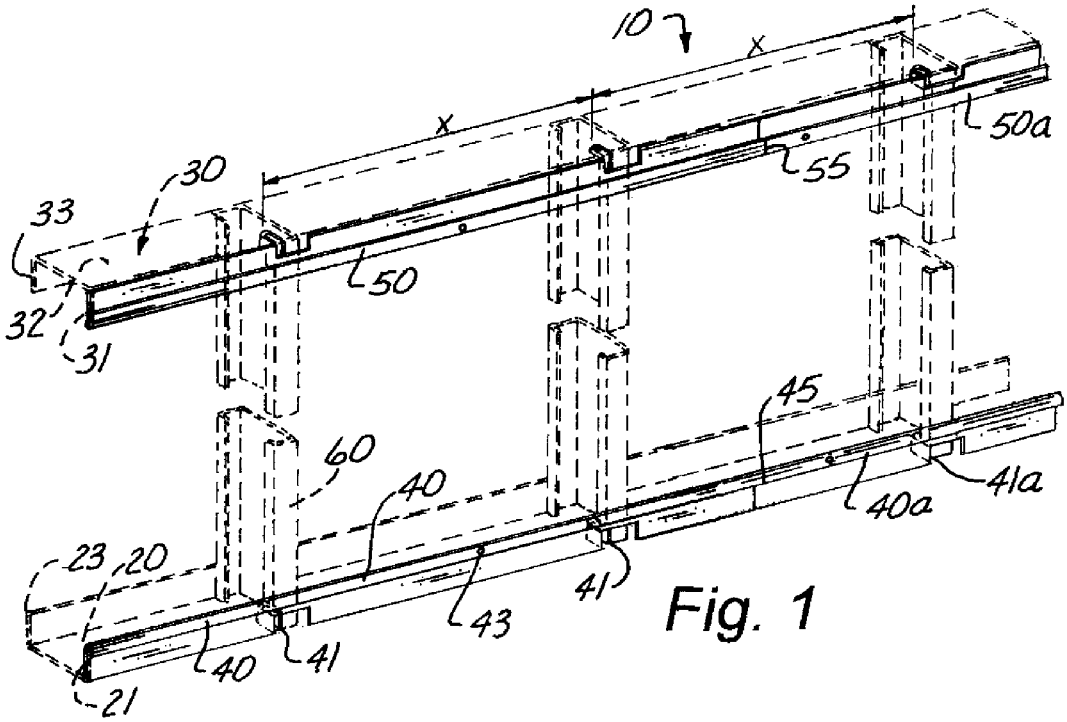
FIG. 1 is a partial perspective view of an upper and lower track having a plurality of metal studs, all shown in dashed lines, and having the present invention attached thereto.

Referring now to the drawings, wherein like reference numerals designate identical or corresponding parts throughout the several views, FIG. 1 shows the present invention in a preferred embodiment (10). FIG. 1 shows a completed wall (10) except for placing sheet rock, shown in FIG. 9, thereon, whereas FIG. 2 shows the final step of installation of the studs (60) shown in FIG. 1.

Figure 2:
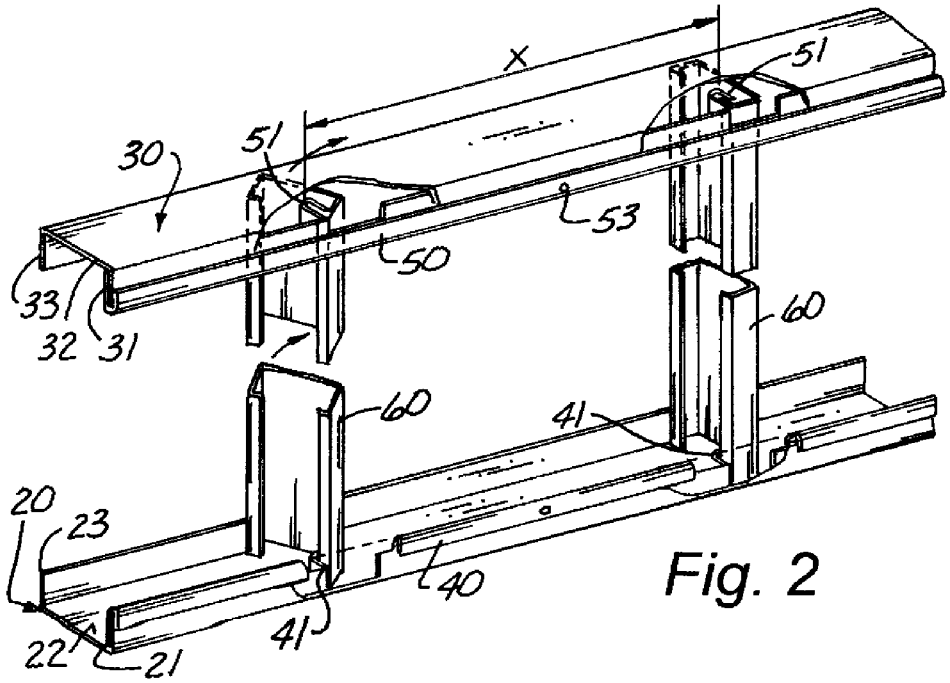
FIG. 2 is a perspective view of a preferred embodiment of the present invention, with portions of the upper track broken away, and with an arrow showing the direction for rotating a stud to install it into an upper and lower track using the present invention.

To practice the present invention of FIGS. 1 and 2, first a first (lower) track (20) is attached to a floor such as by using screws or the like, and a second (upper) track (30) is attached to a ceiling or to something else which will support it at a desired height. Then a first flange (40) is slipped over the first inner lip (21) of the first track as is shown in FIGS. 1 and 2, for example. This flange (40) has a J-shaped cross section and is J-shaped looking at one end thereof though other shapes can be used if desired. The flange (40) has a plurality of J-shaped tabs (41) which have been formed by stamping out a portion of the lower part of the flange (40) as can readily be seen in FIGS. 1, 2, 6 and 10, for example. The first track (20) has a first center portion (22) and a first outer lip (23). Similarly, the second track (30) has a second center portion (32) and a second outer lip (33) which will be referred to later.

Figure 6:
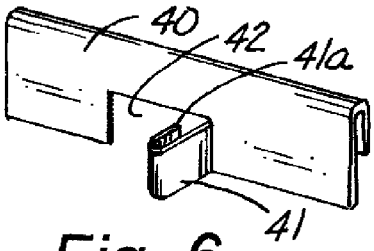
FIG. 6 is a perspective view of a portion of a flange of the present invention in a position as it would be attached to rear lip of a lower track to show a tab for capturing and holding a lip of a vertical stud, though it could be attached to either lip of an upper track or to either lip of a lower track.
Figure 7:
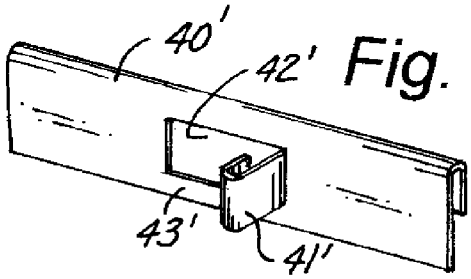
FIG. 7 is a perspective view of a portion of an alternate form of a flange of the present invention in a position as it would be attached to rear lip of a lower track to show a tab for capturing and holding a lip of a vertical stud, though it could be attached to either lip of an upper track or to either lip of a lower track, noting that it differs from the FIG. 6 flange because the tab does not extend to the bottom of the flange in the position shown.

Looking at FIG. 7, it is noted that there is an alternate type of flange (40') which has a flange (41') stamped out of the middle of the flange (40') forming an opening (42') with a section (43') below it. This section (43') is not present in the embodiment shown in FIG. 6. In FIG. 6, in contrast, the opening (42) is larger because the material of tab (41) is used goes all the way to the bottom of the flange (40). These two embodiments shown in FIGS. 6 and 7 are considered to be fully equivalent and can be used interchangeably. Other embodiments are also possible within the spirit and scope of the appended claims.

Looking at FIG. 1 again, it is noted that another tab (41) is disposed to the right of the left-most first tab (41) shown therein and on the first flange (40). These tabs (41) are a distance X from each other, which can for example be sixteen inches (16"), which is the common distance between the center of studs in conventional construction in the United States of America. An optional depression (43) can be formed in one side of the flange (40) to merely create a tighter frictional grip with the inner lip (21) to hold the flange (40) in whatever position is desired on the inner lip (21).

Referring again to FIGS. 1 and 2, it is noted that while a second flange (50) attached to a second inner lip (31) of a second track (30) appears at first glance to be identical to the flange (40) below it, they are actually somewhat of a mirror image of each other because the tab (51) on the second flange (50) extends in the opposite direction when it is manufactured, but when it is flipped over as shown on the upper second track (20), the tab (51) extends to the right in the example shown in FIGS. 1 and 2. An optional depression (53) can be formed in one side of the flange (50) to merely create a tighter frictional grip with the inner lip (31) to hold the flange (50) in whatever position is desired on the inner lip (31).

After the first lower track (20) and second upper track (30) have been installed and the first flange (40) and second flange (50) installed on the inner lips respectively of those upper and lower tracks (20) and (30), then it is time to install the studs (60). To install the studs (60), a stud (60) would first be placed between the tracks (20) and (30) as shown in FIG. 2 and an inner lip (61) of an L-shaped configuration is placed in the position shown in FIGS. 2 and 5 while this same inner lip (61) is in the tab (51) as shown in FIG. 4. By merely grasping the stud (60) in one hand, for example, the stud (60) can be rotated from the position shown in the left in FIGS. 2, 4 and 5 to the position shown on the right in FIGS. 2, 4 and 5. By simply rotating the stud (60) in this fashion, the stud (60) will be snapped into and held in place by the tabs (41) and (51) of flanges (40) and (50).

Referring to FIG. 3, the second or top track (300) is similar to the second or top track (30) shown in FIGS. 1 and 4, except that the second inner lip (301) and the second outer lip (303) is longer relative to the top of the flange (50). For example, the distance B of the first inner lip (301) and the distance from that point upwardly, shown as distance C of the first inner lip (301) equals the distance A, which is the total length of the second outer lip (303). In the embodiment shown in FIG. 3, the inner lip (301) and the outer lip (303) are the same length, although only the lip having the flange (50) thereon need be longer than a typical upper track such as upper track (30) shown in FIG. 1, for example. By having this distance C between the top of the tab (51) and the top of the stud (60), if there is a heavy load, such as snow on a roof or heavy objects on a floor just above a ceiling, on top of the upper track (300), this arrangement will allow the upper track (300) to flex down downwardly. Since the top of the stud (60) is not rigidly attached to the track (300), the stud (60) would not be bent (damaged) as might be the case if a screw or the like extended through the flange (303) and into the stud (60). Due to its simplicity, it is believed that the present invention shown in FIG. 3 can be made at a lower manufactured cost and installed with a lower labor installation cost than the SLP-TRK® brand upper track available from Dietrich Metal Framing Company, in which a screw permanently affixed to a vertical stud can slide in a vertical slot in the upper track.

Looking again at FIG. 1, it is noted that a third flange (40*a*), which ideally is identical in all respects to the first flange (40), abuts the first flange (40) at the end or seam (45). Similarly, a fourth flange (50*a*), which is ideally identical to the second flange (50), abuts the second flange (50) at joint (55). This is important for installation and layout purposes because, looking at FIG. 10, it is noted that the flange (40) is of a predetermined length Y. This predetermined length Y is preferably a multiple of twelve inches (12"), at least in construction that is to occur in the United States of America, which construction uses common building materials that are commonly purchased in lengths and/or widths of one foot (12 inches). That way, lengths of building materials of a dimension of 4' or 8' can be used, for example which is the same length or width of certain other components in the building industry such as sheets of plywood or sheet rock.

Of course if a shorter piece of flange (40) or (50) is needed because of the length the tracks (20) or (30) do not require a full length thereof at any point, then of course the flanges (40) or (50) can be cut off with a simple hand operated sheering tool of a type which is commonly used for cutting sheet metal. Assuming the proper end of the flange (20, 30 or 300) is cut off, the spacing X between the tabs (41) remain at the distance X, which is of course what is desired. There could be instances where another stud is desired and it could be placed at that point in a conventional way with screws or the like.

Figure 8:
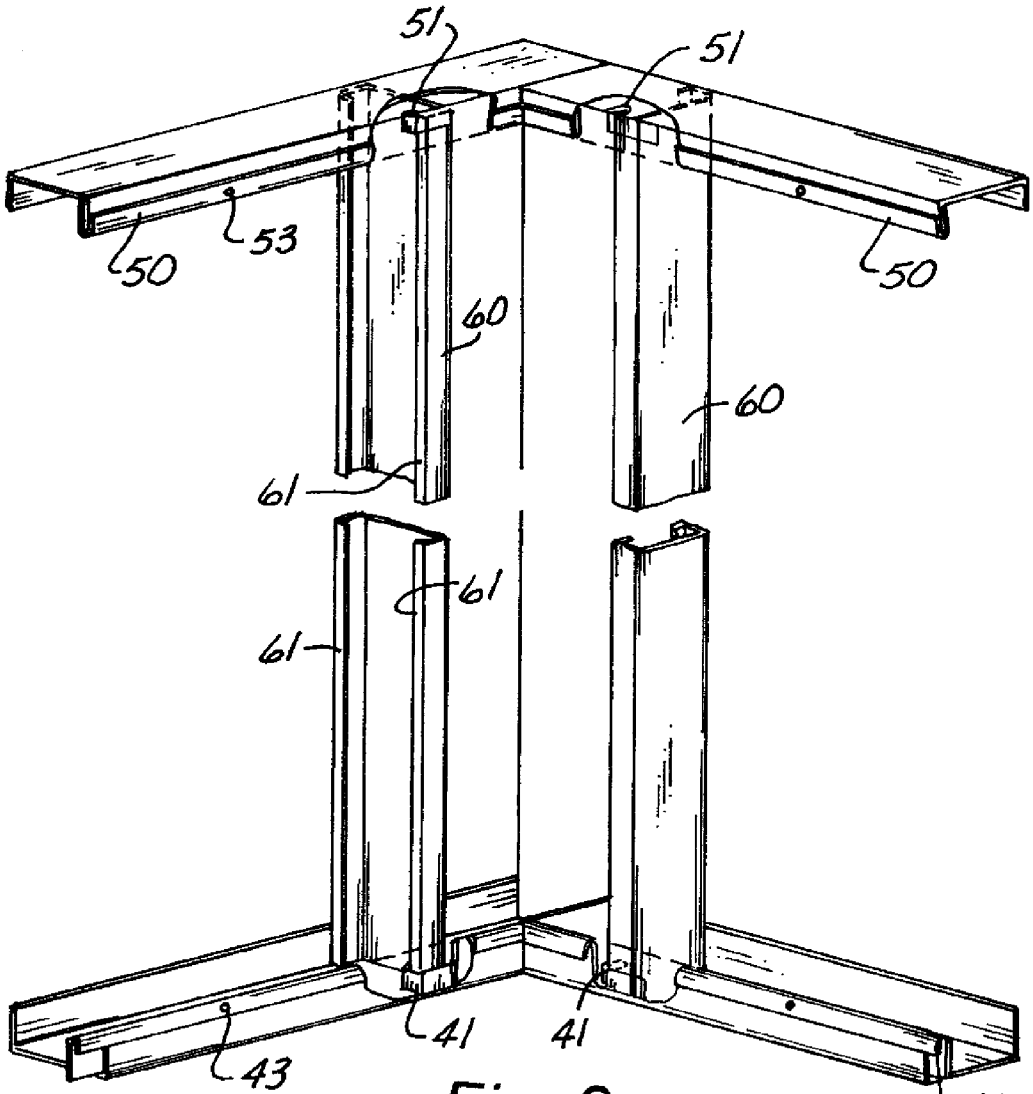
FIG. 8 is a partial perspective view, with portions broken away to show how the ends of studs are captured by the tabs on flanges in a situation where the instant invention is being used in the corner of a room.

FIG. 8 shows a corner configuration using the structures shown in FIGS. 1, 2 and 4-6 for example.

Figure 9:
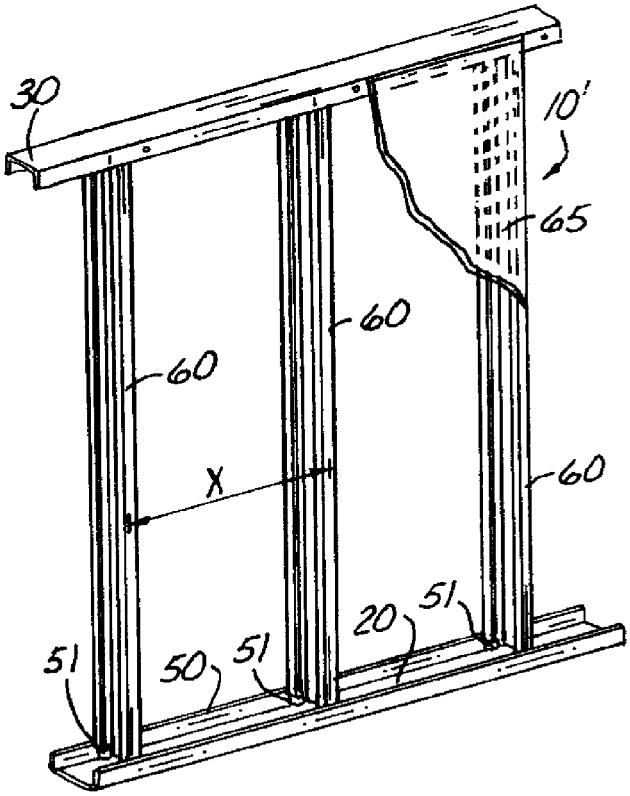
FIG. 9 is a perspective view showing how using the present invention automatically spaces the studs a predetermined distance X apart, center to center and showing sheetrock attached to the wall.
Figure 10:
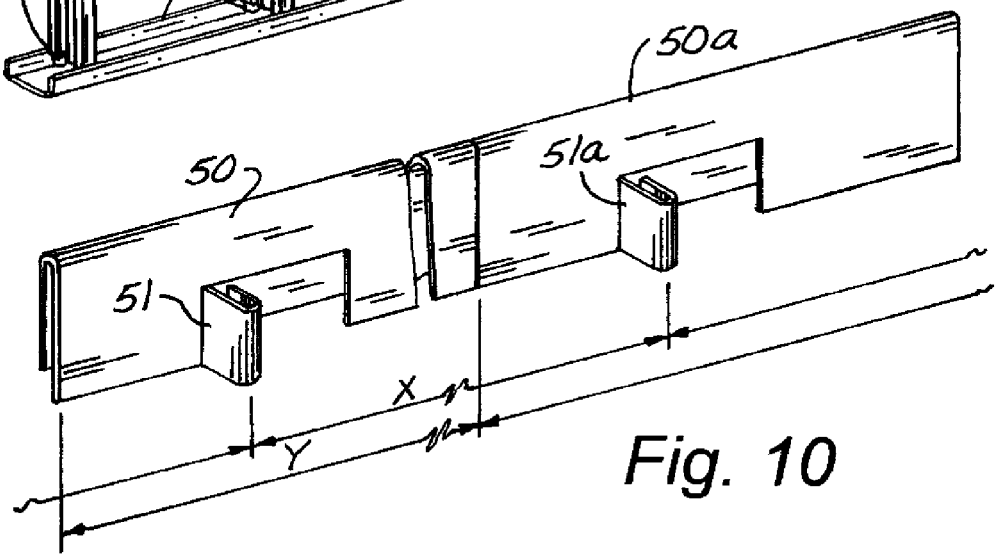
FIG. 10 is a perspective view of two of the flanges of the present invention abutting each other to show how it automatically spaces the tabs a distance X apart so that the studs shown in FIG. 9 will automatically be spaced apart this distance X and how each flange is precut to a length y, which is preferably a multiple of twelve inches especially when used domestically in the USA.

FIG. 9 shows a wall (10') and shows how the studs (60) are a predetermined distance X apart from center to center. FIG. 9 also shows part of a section of sheetrock (64) attached by screws (65) to the studs (60). The sheetrock (64) is typically installed after all of the rest of the wall (10') is installed. FIG. 10 shows identical abutting flanges (50 and 50*a*) which have tabs (51 and 51*a*) respectively attached thereto.

FIGS. 11-18 show the present invention being used with only a flange (50) and tab (51) on a lower track (20) and a similar flange (50) being attached to the upper track (30). In this configuration, only one type of flange (50) with a tab (51) bent in only one direction is needed instead of a second flange (40) which has a different tab (41) bent in a different direction thereon. When using only one flange (50) throughout the entire construction however, it requires a slightly little different installation procedure. For example in FIG. 11, the flange (50) is shown being slipped onto the first outer lip (23) so that the stud (60) can be pivoted at the bottom thereof from the position shown in FIG. 12 to the position shown in FIG. 13 and then on to the position shown in FIG. 14, which is its final resting position. This twisting of the stud (60) looking from above is in a counterclockwise direction.

Figure 15:
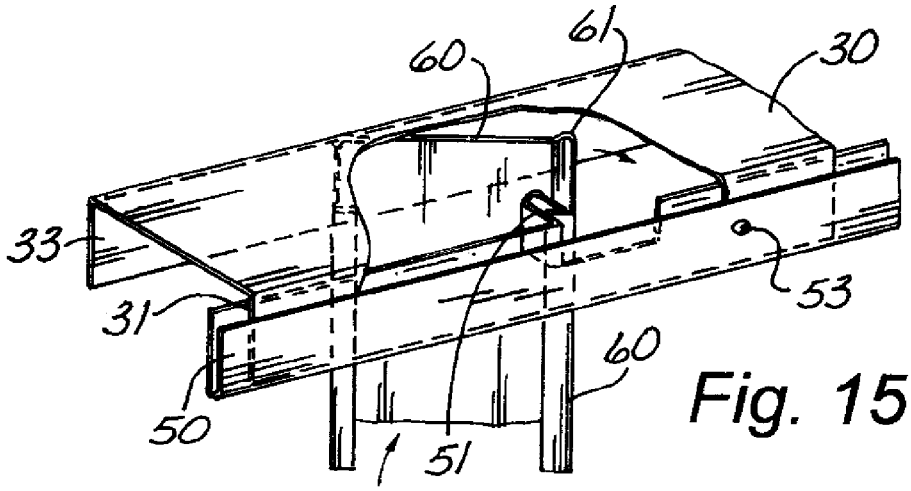
FIG. 15 is a perspective view of an upper portion of a stud being installed in a tab of a flange attached to the inner lip of an upper track by pivoting it in the direction shown by the arrow.
Figure 16:
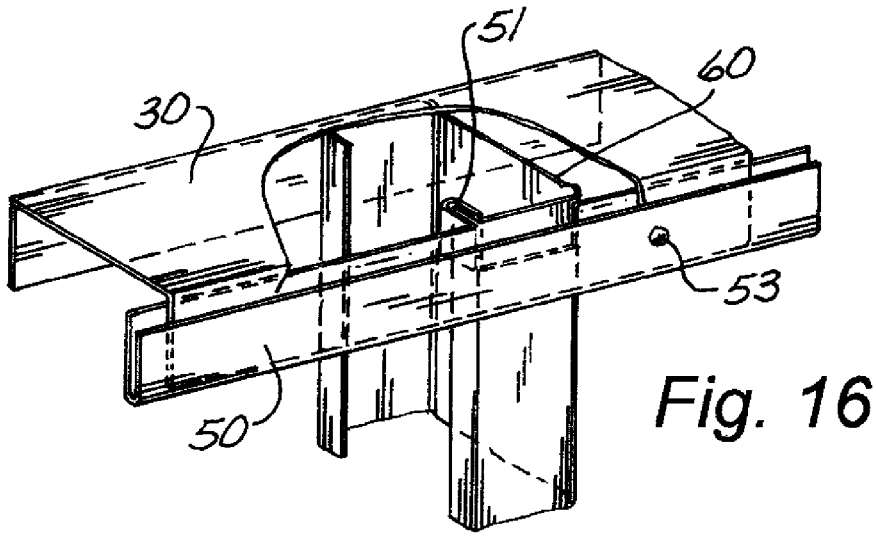
FIG. 16 is a perspective view showing the finally installed position of the structure of FIG. 15.
Figure 17:
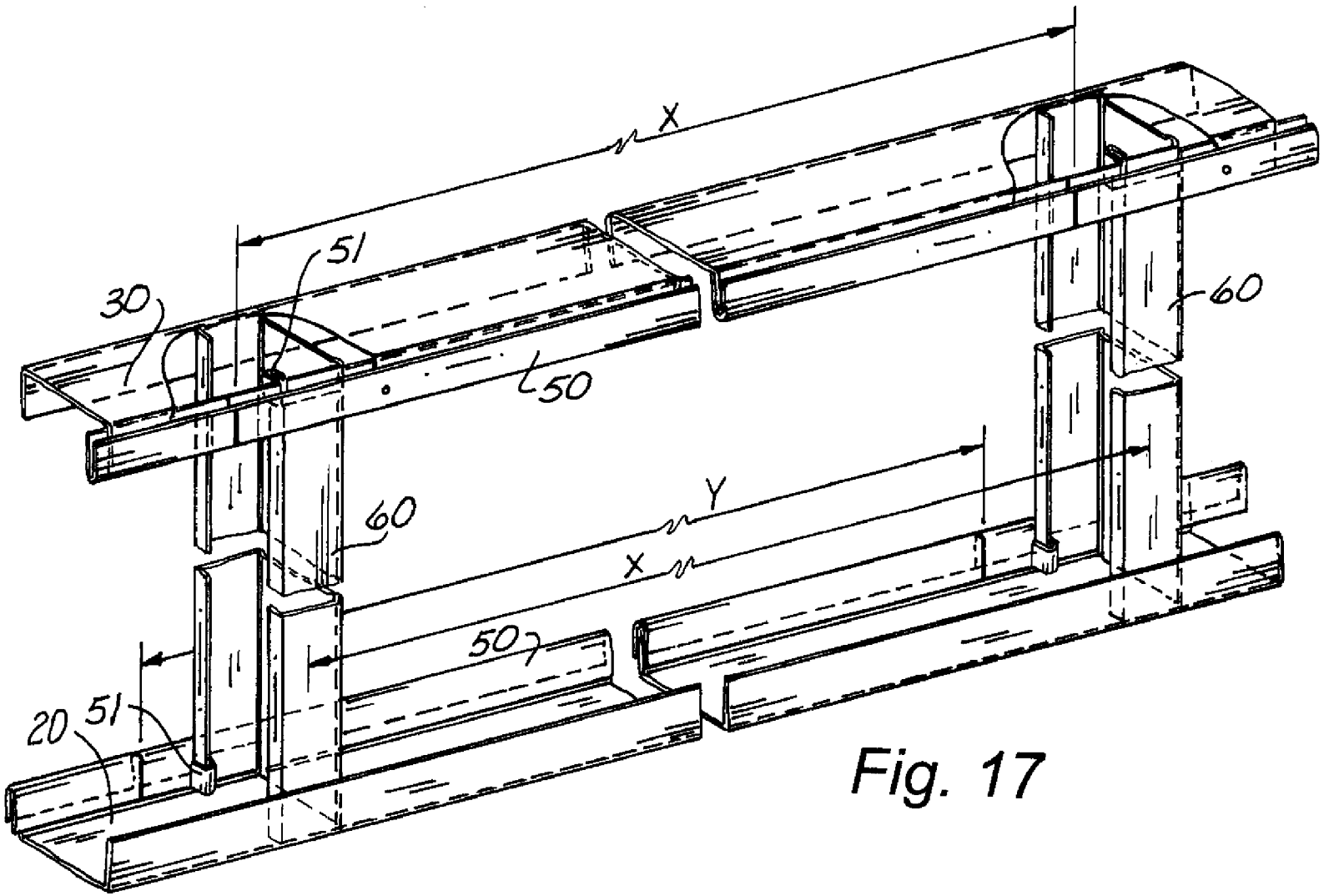
FIG. 17 is a perspective view of an upper track with a flange with tabs thereon on the inner lip and a lower track with a flange on the outer lip thereof to show that the stud can be installed into the tab of the flange on the inner lip of the upper track by twisting the upper part of the stud in one rotary direction and the lower end of the stud can be installed into the tab of the flange on the outer lip of the lower flange by twisting the lower end of the stud in the opposite rotary direction, noting that this can be reversed if the upper flange is placed on the outer lip of the upper track and the lower flange is placed on the inner lip of the lower track.

Now looking at FIGS. 15 and 16, it is noted that the top of the stud (60) needs to be twisted in a clockwise direction (opposite direction to the twisting of the bottom of the stud) so that inner lip (61) of the stud (60) will be captured by the tab (51). Looking to FIG. 16 it is noted that after this rotation in a clockwise direction looking from above, the lip (61) of stud (60) will be captured by the tab (51) and the installation will be complete as shown in FIG. 17. This system is possible because a galvanized steel stud is not totally rigid, so the top can flex in rotation in one direction and the bottom can flex in an opposite direction in rotation to a considerable extent without permanently bending the stud (60). Using this system, the studs (60) will automatically be a distance X apart from center to center and furthermore the distance Y of the flanges from one seam to the next can be of a predetermined length Y to automatically make sure that the studs are spaced this distance X apart even if such flanges (50) have more than two tabs (51) spaced a distance X apart thereon. Of course one could use all flanges (40) instead of all flanges (50) as were used in this example of FIGS. 11-16.

Figure 18:
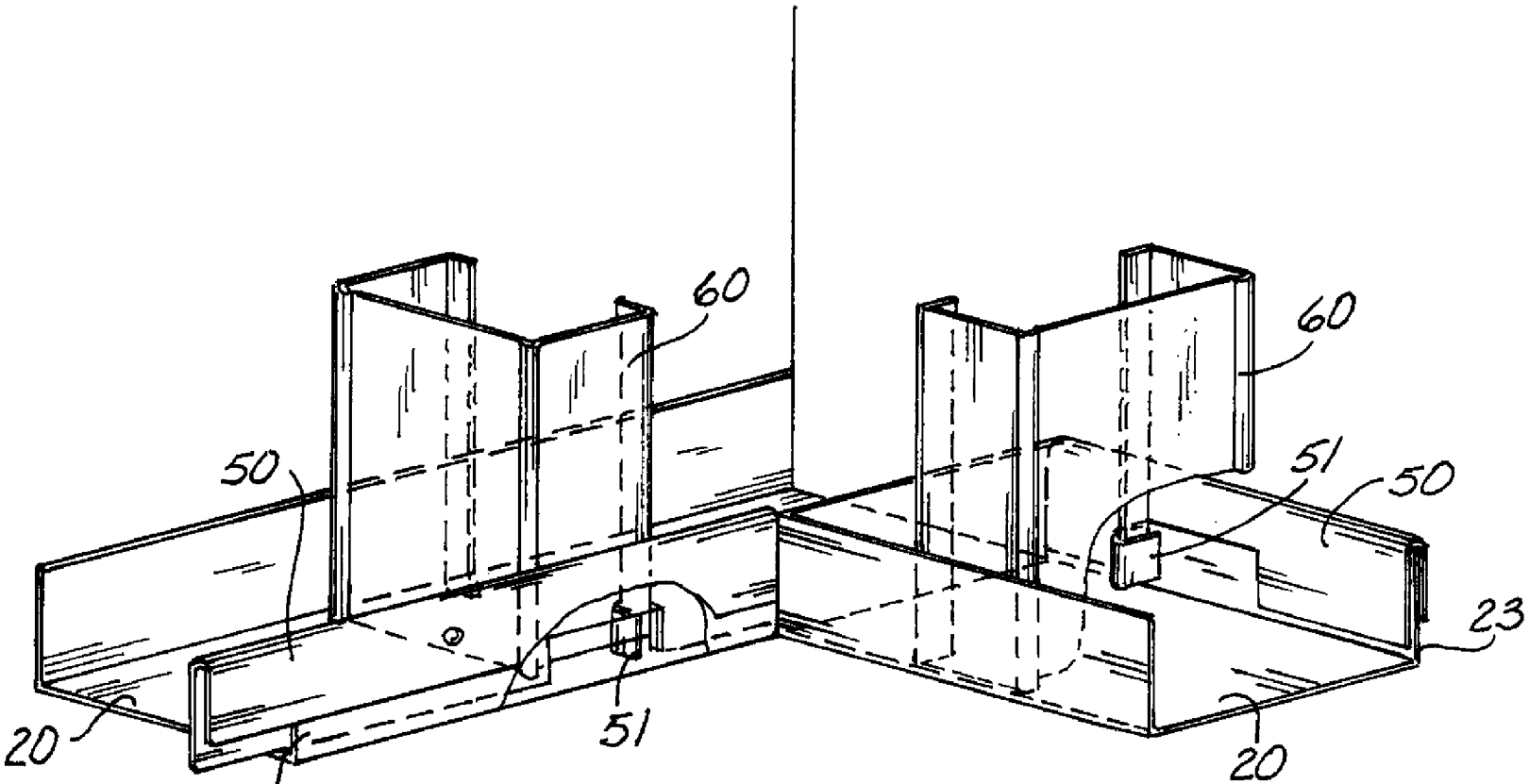
FIG. 18 is a perspective view of a portion of the lower tracks where they meet at a corner and the relative positions of flanges and tabs in one embodiment of the present invention.

FIG. 18 shows a corner arrangement whereby the flange (50) is used on the first inner lip (21) of a lower track (20) and is used on the outer lip (23) of the other lower track (20) at a corner.

Figure 19:
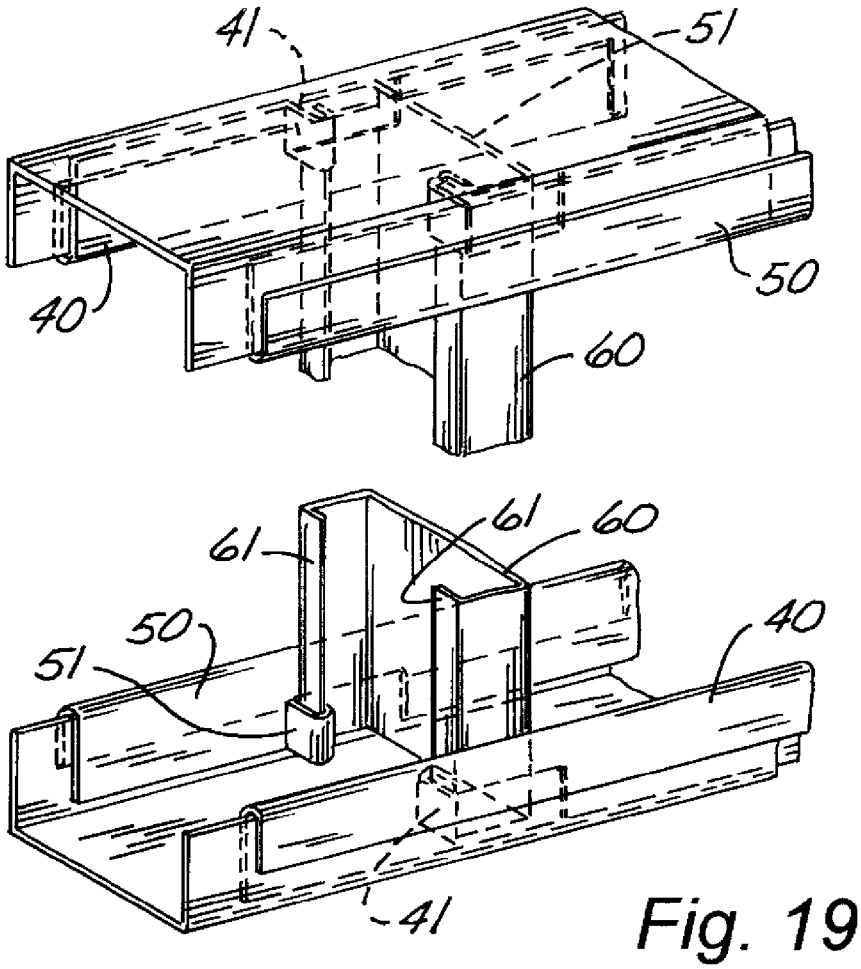
FIG. 19 is a perspective view of an alternate installation wherein an upper and lower track has flanges attached to both the inner and outer lips of both the upper and lower tracks to provide tabs to capture and hold both the inner and outer lips of both the top and bottom of the stud.

A still further embodiment of the present invention is shown in FIG. 19 wherein every lip (61) of the stud (60) is captured either by a tab (41) of a flange (40) or by a tab (51) of a flange (50).

It is further noted that in every embodiment shown, the stud (60) will be held in place sufficiently so that it is not necessary to attach screws between the upper and lower track and the stud (60) because after sheet rock (64) is attached to the wall (10) with screws (65), for example as shown in FIG. 9. The sheet rock (64) when attached to the studs (60) operates to form a solid wall that prevents the studs (60) from moving with respect to the upper and lower tracks (20 and 30). In other words, when the sheet rock (64) is attached by screws (65) to the stud (60) it will make a rigid wall so that no further attaching of the studs (60) to the tracks (20) and (30) is necessary, therefore using less screws or other fasteners and saving labor costs.

Accordingly, it will be appreciated that the preferred embodiment does indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. Apparatus comprising:

a first track having a first center portion, a first inner lip extending from the first center portion and a first outer lip extending from the first center portion, the first center portion being disposed substantially horizontally along a first plane;

a second track having a second center portion, a second inner lip extending from the second center portion towards the first inner lip and a second outer lip extending from the second center portion towards the first outer lip, the second center portion being disposed substantially horizontally along a second plane, the second plane being substantially parallel to the first plane;

a first flange operatively removably attached to the first inner lip, the first flange having first end and a second end;

a first tab which is j-shaped operatively attached to the first flange at one end thereof and having a free end on the other end thereof, the first tab being disposed between the first inner lip and the first outer lip of the first track;

a second flange operatively removably attached to the second inner lip, the second flange having first end and a second end;

a second tab which is j-shaped operatively attached to the second flange at one end thereof and having a free end on the other end thereof, the second tab being disposed between the first inner lip and the first outer lip of the second track;

a stud having a third center portion, a third inner lip extending from the third center portion and a third outer lip extending from the third center portion, the third center portion being disposed substantially vertically alone a third plane, the third plane being substantially transversely disposed with respect to the first plane;

wherein at least a portion of the third inner lip of the stud is disposed between the first tab and the first inner lip of the first track;

wherein at least a portion of the third inner lip of the stud is disposed between the second tab and the second inner lip of the second track; and wherein the first flange has a first flange side disposed on an outer side of the first inner lip of the first track and a second flange side disposed on the inner side of the first inner lip of the first track.

2. The apparatus of claim 1 wherein the third inner lip of the stud is L-shaped and wherein one leg of the L-shaped portion is surrounded on at least two sides by the tab.

3. The apparatus of claim 1 wherein another tab on the first flange is disposed a first predetermined distance from the first said tab.

4. The apparatus of claim 3 wherein the predetermined distance is sixteen inches.

5. The apparatus of claim 3 wherein the first flange is of a predetermined length.

6. The apparatus of claim 5 wherein the predetermined length is a multiple of twelve inches.

7. The apparatus of claim 5 wherein the predetermined length is twelve inches.

8. The apparatus of claim 3 wherein a third flange is operatively removably attached to the first inner lip, the third flange having first end and a second end, said one end of the third flange being in abutment with said other end of the first flange; and a third tab on the third flange, the third tab being disposed by said predetermined distance from the tab on the first flange that is closest to the third tab.

9. The apparatus of claim 8 wherein a fourth flange is operatively removably attached to the second inner lip, the fourth flange having first end and a second end, said one end of the fourth flange being in abutment with said other end of the second flange; and a fourth tab on the fourth flange, the fourth tab being disposed by said predetermined distance from the tab on the second flange that is closest to the fourth tab.

10. The apparatus of claim 1 wherein the stud has a bottom end and a top end and wherein the second center portion is disposed a substantial distance from the top end of the stud so that loads that would cause the second track to bend downwardly will not cause buckling of the stud because the second tab will slide vertically along the stud as the second track bends downwardly instead of imparting a bending force onto the stud as would happen if the stud was rigidly attached to the second track.

11. The apparatus of clam 10 wherein said substantial distance is at least one half of an inch.

12. A method of using the apparatus of claim 1, said method comprising:

moving the stud between a preinstalled position wherein the third inner lip is not disposed between the first tab and the first inner lip of the first track and a second position wherein the third inner lip is disposed between the first tab and the first inner lip of the first track.

13. A method of using the apparatus of claim 1, said method comprising:

moving the stud between a preinstalled position wherein the third inner lip is not disposed between the second tab and the second inner lip of the second track and an installed position wherein the third inner lip is disposed between the second tab and the second inner lip of the second track.

14. The apparatus of claim 1 wherein sheetrock is rigidly attached to said stud.

15. Apparatus comprising:

a first track having a first center portion, a first inner lip extending from the first center portion and a first outer lip extending from the first center portion, the first center portion being disposed substantially horizontally along a first plane;

a second track having a second center portion, a second inner lip extending from the second center portion towards the first inner lip and a second outer lip extending from the second center portion towards the first outer lip, the second center portion being disposed substantially horizontally along a second plane, the second plane being substantially parallel to the first plane;

a first flange operatively removably attached to the first inner lip, the first flange having first end and a second end;

a first tab which is j-shaped operatively attached to the first flange at one end thereof and having a free end on the other end thereof, the first tab being disposed between the first inner lip and the first outer lip of the first track;

a second flange operatively removably attached to the second inner lip, the second flange having first end and a second end;

a second tab which is j-shaped operatively attached to the second flange at one end thereof and having a free end on the other end thereof, the second tab being disposed between the first inner lip and the first outer lip of the second track;

a stud having a third center portion, a third inner lip extending from the third center portion and a third outer lip extending from the third center portion, the third center portion being disposed substantially vertically along a third plane, the third plane being substantially transversely disposed with respect to the first plane;

wherein at least a portion of the third inner lip of the stud is disposed between the first tab and the first inner lip of the first track;

wherein at least a portion of the third inner lip of the stud is disposed between the second tab and the second inner lip of the second track;

wherein another tab which is j-shaped on the first flange is disposed a first predetermined distance from the first tab;

wherein a third flange is operatively removably attached to the first inner lip, the third flange having first end and a second end, said one end of the third flange being in abutment with said other end of the first flange;

a third tab which is j-shaped on the third flange, the third tab being disposed by said predetermined distance from the tab on the first flange that is closest to the third tab wherein a fourth flange is operatively removably attached to the second inner lip, the fourth flange having first end and a second end, said one end of the fourth flange being in abutment with said other end of the second flange;

a fourth tab which is j-shaped on the fourth flange, the fourth tab being disposed by said predetermined distance from the tab on the second flange that is closest to the fourth tab; and wherein a second stud is disposed between the first and second track and spaced by said predetermined distance from the first said stud, said second stud being held in place by the another tab on the first flange.

16. The apparatus of claim 15 wherein said second stud is also being held in place by a further tab on the second flange.

17. Apparatus comprising:

a first track having a first center portion, a first inner lip extending from the first center portion and a first outer lip extending from the first center portion, the first center portion being disposed substantially horizontally along a first plane;

a second track having a second center portion, a second inner lip extending from the second center portion towards the first inner lip and a second outer lip extending from the second center portion towards the first outer lip, the second center portion being disposed substantially horizontally along a second plane, the second plane being substantially parallel to the first plane;

a first flange operatively removably attached to the first inner lip, the first flange having first end and a second end;

a first tab which is j-shaped operatively attached to the first flange at one end thereof and having a free end on the other end thereof, the first tab being disposed between the first inner lip and the first outer lip of the first track;

a second flange operatively removably attached to the second outer lip, the second flange having first end and a second end;

a second tab which is j-shaped operatively attached to the second flange at one end thereof and having a free end on the other end thereof, the second tab being disposed between the first inner lip and the first outer lip of the second track;

a stud having a third center portion, a third inner lip extending from the third center portion and a third outer lip extending from the third center portion, the third center portion being disposed substantially horizontally along a third plane, the third plane being substantially transversely disposed with respect to the first plane;

wherein at least a portion of the third inner lip of the stud is disposed between the first tab and the first inner lip of the first track;

wherein at least a portion of the third outer lip of the stud is disposed between the second tab and the second outer lip of the second track; and wherein the first flange has a first flange side disposed on an outer side of the first inner lip, the first flange having a second flange side disposed on the inner side of the first inner lip.

18. The apparatus of claim 17 wherein the second flange has a first flange side disposed on an outer side of the second outer lip, the second flange also having a second flange side disposed on the inner side of the second outer lip.

* * * * *